United States Patent [19]

Piccone

[11] Patent Number: 4,905,879

[45] Date of Patent: Mar. 6, 1990

[54] EXPANDABLE WATCHBAND

[76] Inventor: Adrian J. Piccone, 219 Farwood Rd., Philadelphia, Pa. 19151

[21] Appl. No.: 228,069

[22] Filed: Aug. 4, 1988

[51] Int. Cl.[4] ..... A44C 5/14

[52] U.S. Cl. ..... 224/173; 224/175; 224/176; 224/221; 224/267; 63/21; 368/282

[58] Field of Search ..... 224/164, 167, 168, 170, 224/171, 173, 175, 176, 178, 180, 219, 221, 222, 267; 63/5.1, 21; 368/281–283

[56] References Cited

U.S. PATENT DOCUMENTS

| | | | |
|---|---|---|---|
| Re. 24,502 | 7/1958 | Myerson | 224/175 |
| 2,558,007 | 6/1951 | Smith | 224/175 |
| 2,695,740 | 11/1954 | Kolbe | 224/175 |
| 2,827,309 | 3/1958 | Fred | 224/219 X |
| 2,998,695 | 9/1961 | Cornett | 224/171 X |
| 3,693,375 | 9/1972 | Paulsen | 224/175 |
| 3,706,404 | 12/1972 | Gluckin | 224/175 |
| 3,991,921 | 11/1976 | Hirsch | 224/168 |
| 4,155,219 | 5/1979 | Anderson | 368/282 |
| 4,757,926 | 7/1988 | Leo | 224/178 |

*Primary Examiner*—Henry J. Recla
*Assistant Examiner*—Robert M. Fetsuga
*Attorney, Agent, or Firm*—Norman E. Lehrer

[57] ABSTRACT

An expandable watchband is described which is both simple and inexpensive to manufacture and simple to use. The watchband includes an outer flattened tubular member of flexible fabric material with one end of the tube folded into itself so that the length of the tube can be adjusted. An elongated strap of flexible elastic material has one end secured to one end of the tube. The other end of the strap passes through the entire length of the tube and out the first end again where it is then adjustably connected to the second end of the tubular member. The watch is connected to the elastic strap between the two ends of the tube. If desired, a trademark, advertising or other printed indicia can be printed on the outer surface of the tubular member.

4 Claims, 2 Drawing Sheets

EXPANDABLE WATCHBAND

BACKGROUND OF THE INVENTION

The present invention is directed toward an expandable watchband and, more particularly, toward such a watchband which is simple and inexpensive to manufacture and simple to use.

Expandable watchbands have been known and used for many years. These have a significant advantage over other types of watchbands since they are automatically adjustable to fit different size wrists. Furthermore, watches with expandable bands can be put on a person's wrist by simply passing his hand therethrough. This eliminates the need to fumble with a clasp or buckle or the like.

Many prior art expandable watchbands are comprised of a plurality of metal links which are connected together by spring mechanisms. Such bands are relatively expensive to manufacture. Furthermore, as the links expand and then move closer to each other, they can frequently pinch the wearer's skin making them somewhat uncomfortable.

Attempts have been made to partially or fully cover the expandable element in an expandable watchband. These attempts are shown, for example, in U.S. Pat. Nos. 2,558,007; 2,695,740; 3,693,375 and Re. 24,502. To Applicant's knowledge, none of these patented watchbands have met with any commercial success. They appear to be relatively complex and, therefore, difficult and expensive to manufacture. Furthermore, they appear to be relatively rigid and would, therefore, appear to be uncomfortable to wear. Even further, none of the prior art devices known to Applicant are comprised of a material which can be easily decorated or printed thereon.

SUMMARY OF THE INVENTION

The present invention overcomes all of the disadvantages of the prior art discussed above and provides an expandable watchband which is both simple and inexpensive to manufacture and simple to use. The watchband of the invention includes an outer flattened tubular member of flexible fabric material. One end of the tube is folded into itself so that the length of the tube can be adjusted. An elongated strap of flexible elastic material has one end secured to one end of the tube. The other end of the strap passes through the entire length of the tube and out the first end again where it is then adjustably connected to the second end of the tubular member. The watch is connected to the elastic strap between the two ends of the tube. If desired, a trademark, advertising or other printed indicia can be printed on the outer surface of the tubular member.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
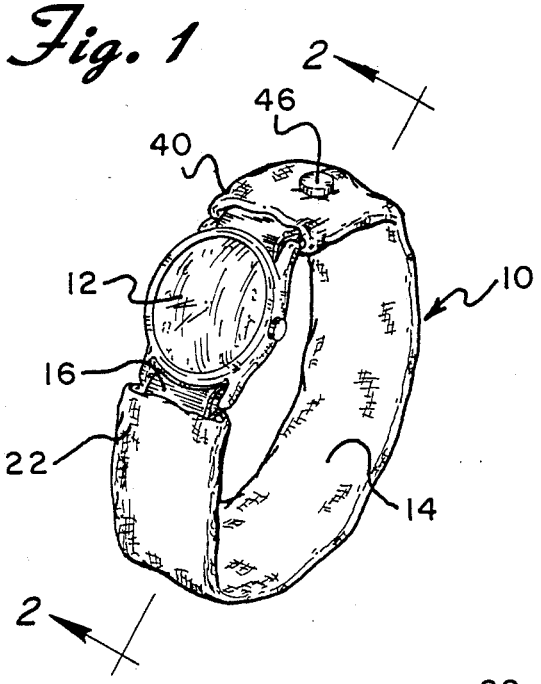
FIG. 1 is a perspective view of an expandable watchband with a wristwatch connected thereto and which is constructed in accordance with the principles of the present invention.

Referring now to the drawings in detail wherein like reference numerals have been used throughout the various figures to designate like elements, there is shown in FIG. 1 a prospective view of an expandable watchband constructed in accordance with the principles of the present invention and designated generally as 10. The watchband 10 is shown in use connected to a watch face 12.

Figure 3:
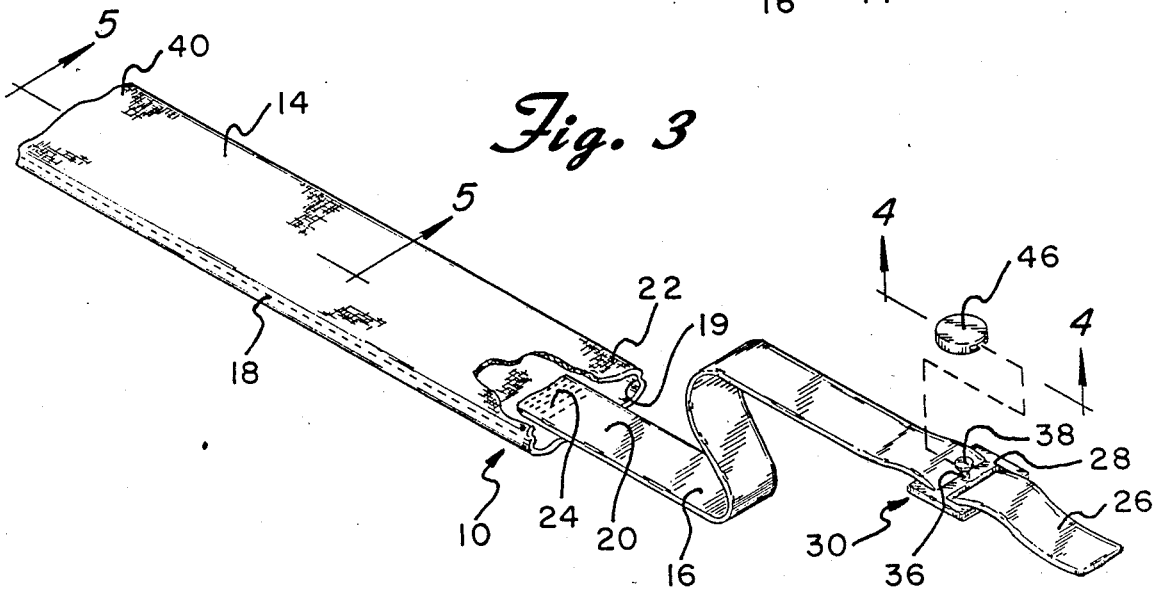
FIG. 3 is a perspective view of the expandable watchband of the present invention showing the same in its expanded condition.
Figure 4:
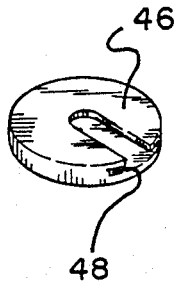
FIG. 4 is a perspective view of the bottom side of a portion of a clasp useful with the invention.

As shown most clearly in FIG. 3, the watchband 10 is comprised essentially of two parts: a flattened tubular member 14 and an elongated strap of flexible elastic material 16. Although the elastic strap is shown as being continuous, it is possible to interconnect portions of inelastic material along the length thereof. The tubular member 14 is preferably made of a fabric material such as cotton or the like. It is possible, however, to use various other types of fabric, cloth or plastic materials. The material from which the tubular member 14 is made, however, must be relatively flexible.

Figure 5:
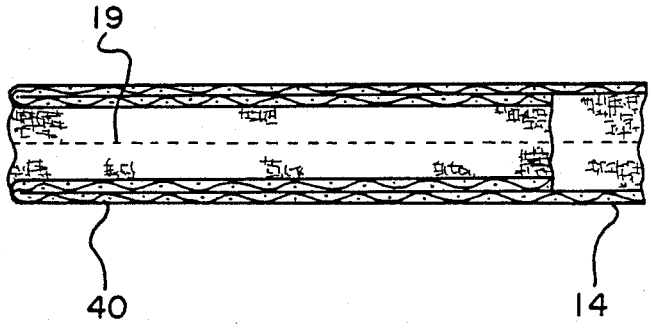
FIG. 5 is a cross-sectional view taken through the line 5—5 of FIG. 3.

The tubular member 14 is preferably made from two flat sheets of material which are placed on top of each other and then sewn together along both side edges as shown by the stitching 18 and 19 in FIGS. 3 and 5. The width of the flattened tubular member 14 may be approximately $\frac{3}{4}$ to 1 inch although this width may vary depending on the size of the watch face to which the band is to be connected and the desires of the person wearing the watchband. Fashionable variations such as scalloped or undulated edges or other variations along the length of the tube are also possible. The overall length of the tubular member 14 is approximately 6 to 8 inches. Again, however, this length may vary.

Referring again to FIGS. 2 and 3, it can be seen that the elongated strap 16 of elastic material has its first end 20 securely fastened to the first end 22 of the tubular member 14. This is preferably done by stitching the end 20 of the strap 16 to the inside of the first end 22 of the tubular member 14 such as shown by the stitches 24 in FIG. 3. The free second end 26 of the strap 16 carries the first part 28 of a two-part clasp 30. This clasp part 28 has a pair of slots 32 and 34 formed therein (FIG. 6) through which the free end 26 of the strap 16 can pass. In this way, the position of the clasp 30 on the strap 16 can be adjusted as desired. Extending upwardly from the center of the clasp part 28 is a pin 36 having a slightly enlarged head 38 thereon.

The expandable watchband 10 is used in the following manner. As can best be seen from FIG. 2, the flattened tubular member 14 is rolled into a substantial C-shape so that its free second end 40 is opposite the first end 22. The elastic strap 16 which extends outwardly from the first end 22 of the tubular member 14 passes under the watch 12 and enters the free end 40 of the tubular member 14. From there, the strap passes entirely through the interior of the tubular member 14 and again exits the first end 22 at a position above the place where its first end 20 is secured to the tubular member 14. After again extending out of the first end 22 of the tubular member 14, the strap 16 passes over a first watch pintle 42, under the watch face and then up and around the second pintle 44. The free end 26 of the strap 16 then again extends into the free end 40 of the tubular member 14. The pin 36 carried by the clasp part 28 is then forced through the upper wall of the fabric material at the end 40 of the tubular member 14. Second clasp part 46 which has an undercut slot 48 formed in the bottom thereof is then slid over the head 38 to close the clasp and maintain the same in place. In lieu of forcing the pin 36 of the clasp part 38 through the fabric material, it is also possible to preform a plurality of holes therein. This may be necessary in some situations depending on the particular material utilized to make the tubular member 14.

Figure 2:
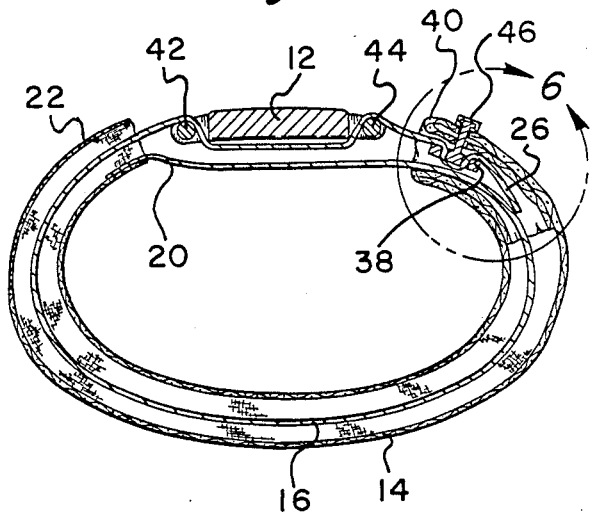
FIG. 2 is a cross-sectional view taken through the line 2—2 of FIG. 1.
Figure 6:
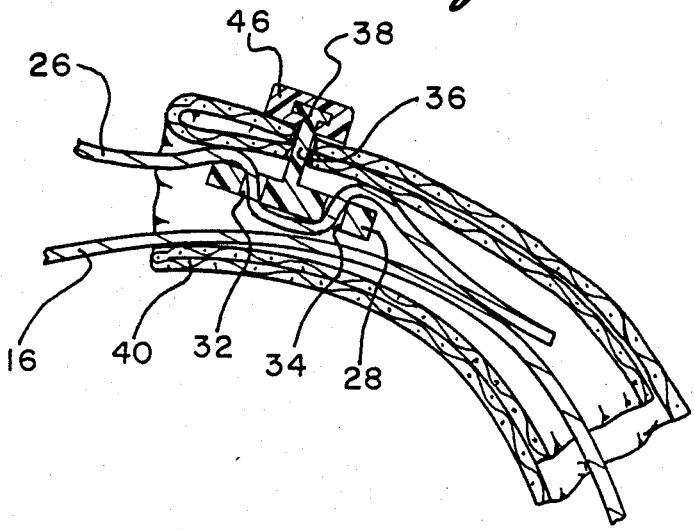
FIG. 6 is a cross-sectional view showing the details of a portion of FIG. 2.

It may, on occasion, be necessary to adjust the overall length of the tubular member 14. As shown most clearly in FIGS. 5 and 6, this is accomplished by folding the free end 40 of the tubular member 14 over inwardly upon itself to form a double coaxial tubular member at the second end of the tubular member. As should be readily apparent, the length of the tubular member 14 can now be easily adjusted by simply folding more or less of the end 40 into itself. As shown in FIGS. 2 and 6, the pin 36 must then pass through two layers of the material making up the tubular member 14 which adds to the strength of the connection. Thus, the watchband is precisely adjustable in both length and tension. One size fits all.

As a result of the arrangement of the invention, the expandable watchband 10 is capable of a very significant amount of expansion without undue force. This results from the fact that substantially the entire length of the elastic member 16 is evenly and equally stretched when it is desired to expand the watchband such as when the same is being slid over a person's hand. Furthermore, as the elastic strap contracts upon release, it pulls the flexible tube flat and smooth so that any writing thereon can be easily read.

Because the tubular member 14 can be made of a flexible fabric material such as cotton or the like, it can function as a sweatband therefore making the same comfortable to wear. Even further, different materials can be used for the inner sheet of material and for the outer one. In a preferred embodiment, the nature of the surface of the outer sheet forming the tubular member 14 allows it to carry various designs, trademarks or logos thereon. This indicia can be easily printed or otherwise formed on the flat fabric before it is made into the tubular member 14.

The present invention may be embodied in other specific forms without departing from the spirit or essential attributes thereof and accordingly reference should be made to the appended claims rather than to the foregoing specification as indicating the scope of the invention.

I claim:

1. An expandable watchband comprising:

an outer flattened tubular member of flexible fabric material, said tubular member having a first end adapted to be located adjacent one side of a wristwatch and a second end adapted to be located adjacent the second side of said watch;

said second end of said tubular member being folded over inwardly upon itself to form a double coaxial tubular member at said second end whereby the length of said tubular member can be adjusted by adjusting the amount of material that is folded over at said second end;

an elongated strap of flexible elastic material, said strap having a first end and a second end, said first end of said strap being securely fastened to the first end of said tubular member with said strap extending outwardly from said tubular member;

said strap adapted to pass from said first end of said tubular member under said watch, into said second end of said tubular member, through the entire length of said member and again out of the first end of the tubular member where it would pass over a first watch pintle, under the watch face and up and around the second watch pintle, the free second end of said strap thereafter again entering the second end of said tubular member, and releasable connecting means connecting the free second end of said strap to the second end of said tubular member.

2. The watchband as claimed in claim 1 wherein said connecting means passes through the wall of the second end of said tubular member.

3. The watchband as claimed in claim 1 wherein said connecting means is adjustably connected to said strap so that it can be secured at different positions thereon.

4. The watchband as claimed in claim 1 wherein the outer surface of said tubular member carries written indicia thereon.

* * * * *